US011279533B2

(12) United States Patent
Grobman

(10) Patent No.: US 11,279,533 B2
(45) Date of Patent: Mar. 22, 2022

(54) CONTAINER ADDITIVE SYSTEM

(71) Applicant: Katie Grobman, New York, NY (US)

(72) Inventor: Katie Grobman, New York, NY (US)

( * ) Notice: Subject to any disclaimer, the term of this patent is extended or adjusted under 35 U.S.C. 154(b) by 0 days.

(21) Appl. No.: 16/836,819

(22) Filed: Mar. 31, 2020

(65) Prior Publication Data

US 2020/0307878 A1 Oct. 1, 2020

Related U.S. Application Data

(60) Provisional application No. 62/827,115, filed on Mar. 31, 2019.

(51) Int. Cl.
*B65D 51/28* (2006.01)
*B67B 7/86* (2006.01)

(52) U.S. Cl.
CPC ..... *B65D 51/2835* (2013.01); *B67B 7/28* (2013.01)

(58) Field of Classification Search
CPC ..... B65D 51/2814; B65D 51/2821; B65D 51/2828; B65D 51/2835; B65D 81/3211; B65D 51/2842; B65D 51/285; B67B 7/24; B67B 7/26; B67B 7/28
See application file for complete search history.

(56) References Cited

U.S. PATENT DOCUMENTS

2007/0039975 A1* 2/2007 Bochtler ..... B65D 81/3211 222/142.5
2007/0289670 A1* 12/2007 Johns ..... B65D 81/3211 141/383
2011/0042944 A1* 2/2011 Johns ..... B01F 15/0225 285/330
2014/0361016 A1* 12/2014 Moreau ..... B65D 51/2835 220/502
2017/0341832 A1* 11/2017 Pelamo ..... B65D 41/0407
2018/0134468 A1* 5/2018 Gentile ..... F26B 25/063

* cited by examiner

*Primary Examiner* — Donnell A Long
(74) *Attorney, Agent, or Firm* — Arrubla Taylor PA; Andres F. Arrubla, Esq.

(57) ABSTRACT

Embodiments of the present disclosure include a container additive system that can be used to mix an additive separately contained inside a receptacle with the contents of a container. The system can enable separate transport of additives for the contents of the container in a sterile and convenient manner that enables mixing according to a user's preferences before the opening of the container and dispensing. According to some aspects, the system can include a breacher configured to connect the insides of the container and receptacle. The receptacle may be rigid, flexible bag type container or a hybrid thereof, depending on the application and side of the additive. In some embodiments, the system or parts thereof may serve as a cap or lid to the container. The container is also not limited to rigid or semi rigid surfaces but can also include flexible bag type or hybrids of flexible and rigid surfaces.

13 Claims, 5 Drawing Sheets

CONTAINER ADDITIVE SYSTEM

CROSS REFERENCE TO RELATED APPLICATION(S)

The present application claims priority to and incorporates by reference United States Provisional Patent Application Ser. No. 62/827,115, filed on Mar. 31, 2019, entitled "A container Additive System".

FIELD OF THE INVENTION

This invention relates to the field of packaging and more particularly to a container additive system used to couple a receptacle to a sealed container enabling dispensing and mixing of separately packaged contents.

BACKGROUND OF THE INVENTION

Widespread use of packaging has been adopted in a variety of industries, including, for example, the food industry, cosmetics, household products, and personal care products. In some cases, and in the case of the disposable packaging of condiments, the existing packaging design options have been driven by food preservation and only enable the user to select from separately packaged condiments he/she wants to add to the particular meal or drink. As a result, conventional disposable packaging solutions are typically limited to a single type of a condiment/solution/additive/component/mixture per package. Pre-mixed or prepaired product package solutions of course do not allow the user/retailer to control ratios or to independently manage in accordance with individual component shelf life, and as a result, greater inventory and shelf space are needed for mixtures or pairings in order to cater to a wider range of consumers with different preferences. Single condiment/component/additive package solutions that enable a user to create his/her own mixture or pairing require individual packages which in many applications is unnecessarily wasteful and/or space consuming. In using a combination of existing single condiment/component/additive package solutions, a user is generally presented at least with the mixing challenge that requires a separate container; decreasing convenience and practicality and adding to the cost.

While materials have continued to evolve, for example, so that they are more resistant to bacteria or to extend shelf life of products, design and practical solutions for a single package to include a main content and at least one separate additive for the main content have been stagnant. For example, most existing package alternatives are not able to enable mixing of controlled amounts of two or more components before dispensing, nor enable user pairing of contents of selected products from complementary packages in a practical and improved manner. Accordingly;

There is a need for a relatively low-cost packaging solution that can be used for more than one type of product and is designed to reduce waste materials;

There is a need for packaging that allows a user to mix amounts of two or more separately contained products in a single package prior to dispensing;

There is a need for packaging that enables a reduction of shelf space without decreasing the options available to the consumer;

There is a need for packaging for an additive receptacle that can be incorporated into a container as to reduce overall footprint and enable practical and controlled addition/mixing; and There is a need to consolidate a product and one or more additive to the product packages into separate but complementary packages.

Accordingly, improved practical disposable configurable packages that can be easily and relatively inexpensively manufactured and overcome the aforementioned needs are desired.

SUMMARY OF THE INVENTION

The foregoing needs are met, to a great extent, by the present invention, wherein in some aspects of embodiments of the invention are intended to address one or more of the above noted fundamental problems associated with existing packaging and container solutions. An improved container additive system is taught for dispensing of products, for example, allowing a user to mix/pair controlled amounts of one or more additive from a complementary receptacle that can be or is integrated into a product container for mixing with the contents of the product container in a practical way and prior to dispensing.

According to some aspects of the disclosure, a container additive system including a coupler that can be configured to connect with a puncturing structure having a dispensing path leading to a receptacle for the addition of an additive is disclosed. The coupler having a base configured to be affixed to a sealed container containing contents that can be complemented by the additive. In accordance with some aspects, the puncturing structure can be engaged to breach the sealed container after the base is affixed to the sealed container forming a channel between the receptacle and the inside of the sealed container, and the channel leading to the dispensing path of the puncturing structure configured to dispense at least some of the additive onto the contents of the receptable.

In some embodiments, the coupler can have a tubular body having a coupling mechanism used to connect the puncturing structure inside the tubular body. The base of the coupler may also include an adhesive for the affixing of the coupler onto the container. Alternatively, the coupler can serve as a cap/lid of the container.

In some embodiments, the puncturing structure includes a cone shaped helical breacher used to breach a portion of a surface of the container. In addition or alternatively, the puncturing structure includes a sharp blade type breaching structure at the tip of the puncturing structure which can serve to breach a portion of a surface of the container. In accordance with additional aspects, the puncturing structure may a coupling mechanism to connect the receptable thereon, or have an integrated receptacle for separate containment of an additive.

A more detailed explanation of the invention and aspects thereof is provided in the following detailed descriptions and appended claims taken in conjunction with the accompanying drawings.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. Reference will now be made to the accompanying drawings, which are not necessarily drawn to scale. Like reference numerals may indicate corresponding parts in various drawings. Without limiting the range of possible configurations, the foregoing and other features or aspects of the present disclosure will be more readily apparent from the following detailed description and drawings of exemplary illustrative embodiments of the invention in which.

Figure 1:
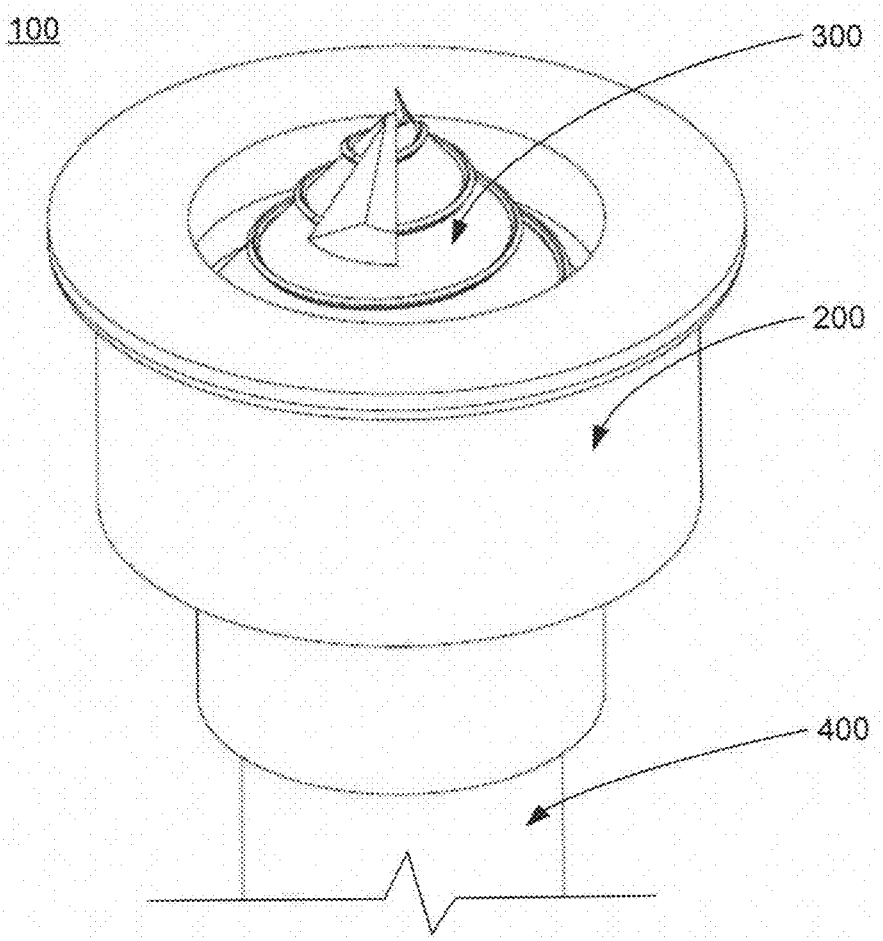
FIG. 1 is an isometric view of an exemplary container additive system according to aspects of the disclosure.

The present invention is further described in the detailed description that follows.

DETAILED DESCRIPTION

Going forward, various aspects of the configurable packet of the present disclosure may be illustrated by describing components that are coupled, attached, and/or joined together. As used herein, the terms "bonded", "coupled", "attached", and/or "joined" are used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements present.

Relative terms such as "lower" or "bottom" and "upper" or "top" may be used herein to describe one element's relationship to another element illustrated in the drawings. It will be understood that relative terms are intended to encompass different orientations of the steering device in addition to the orientation depicted in the drawings. By way of example, if aspects of the container additive system shown in the drawings are turned over, elements described as being on the "bottom" side of the other elements would then be oriented on the "top" side of the other elements. The term "bottom" can therefore encompass both an orientation of "bottom" and "top" depending on the particular orientation.

Various aspects of the container additive system may be illustrated with reference to one or more exemplary embodiments. As used herein, the term "exemplary" means "serving as an example, instance, or illustration," and should not necessarily be construed as preferred or advantageous over other embodiments of the container additive system or assembly disclosed herein.

Glossary

In this description and claims directed to the disclosure, various terms may be used for which the following definitions will apply:

"Additive", as used herein, can refer to a compound, substance, topping, reactant, colorant, enhancer or modifier which may be added to a container's contents. In the food packaging field, by way of non-limiting example, additives may be condiments or supplements and can include wet/dry edible products that are individually packaged for a consumer to add to food/drink.

"Container", as used herein, can refer to a flexible or rigid container having or being adaptable to include or receive a rigid connector/coupler. In some embodiments, the rigid connector or coupler can mate with the container's corresponding connector designed for a standard cap. Containers may include, for example, bottles, plastic bags, high density polyethylene or wood derivative boxes, paper containers, or any combination of the such.

"Controllable dispensing", as used herein, can refer to dispensing from the container subsequent to the additive from the receptacle being mixed with the contents of the container.

"Controllable mixing", as used herein, can refer to the mixing of all or variable amounts (as per user preference) of the additive with the contents of the container without transferring/removing either the additive or the contents from the container exposing the container or receptacle contents to the environment.

"Pre-perforated", as use herein, can refer to small indentations or micro sized holes made to pre-defined portions one or more of the walls of compartment as to enable a user to easily create an outlet for dispensing of the additive into the container.

"Re-enforcement strip(s)", as used herein, can refer to one or more strips of material added near the pre-perforated sections to prevent rupture or expansion of the tear past the pre-perforated sections.

"Exterior walls", as used herein, refers to rigid/non-rigid (e.g., polyethylene, polyvinylidene chloride, homopolymer of vinylidene chloride, aluminum laminated plastics, etc.) walls facing towards the outside of the container or cap.

"Breach", "Tear", "break", or "open", as used herein with respect to a portion of the container or receptacle, can refer to an action by the user to communicate the receptacle to the inside of the container.

"Valve", as used herein, can refer to a plastic insert used to control the flow of an additive from the receptacle in/out of the container. In some embodiments, the plastic insert can serve as a one-way valve that can be opened via manual manipulation of the user in order to allow the flow of additive into the container.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as one skilled in the art would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure, which is defined solely by the appended claims and applicable law.

Referring now to FIG. 1, an isometric view of an exemplary container additive system 100 according to aspects of the disclosure is shown. The container additive system 100 enables aspects of the invention by a coupler 200 and a compatible puncturing structure 300. The coupler 200 may be configured to fit specific features of existing packaging solutions' (not shown) caps/lids (e.g. a bottle's screw cap)

or, as shown, may include universal features of its own to enable use through different package material types and shapes. In accordance with some aspects, the coupler 200 can engage a puncturing structure 300 such that a user can engage one or both of the coupler 200 and the puncturing structure 300 to enable the breaching of a container (not shown). Engagement may include rotation of one in relation to the other or push force of one against the other. In accordance with yet additional aspects, the puncturing structure 300 may include features for mating with a receptacle 400 containing an additive to be added into the packet container (not shown). In some embodiments, the puncturing structure 400 may be disposable and it may be desired to incorporate the receptacle in the puncturing structure 300.

Figure 2A:
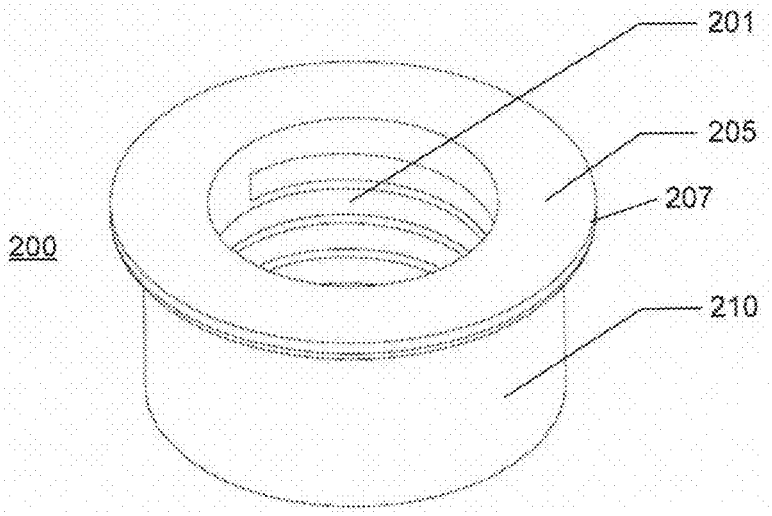
FIG. 2*a* is an isometric view of an exemplary coupler according to aspects of the disclosure.
Figure 5:
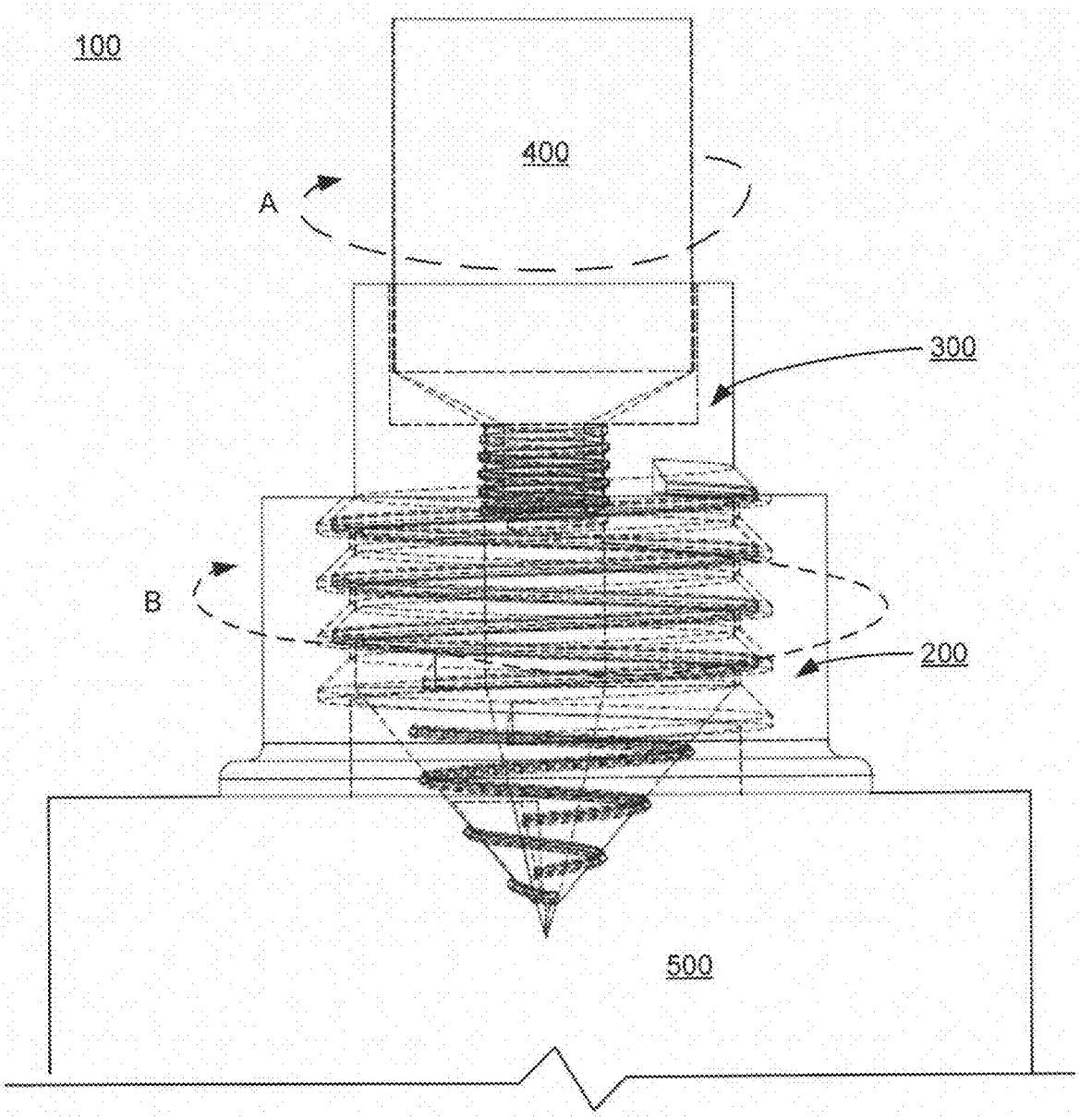
FIG. 5 is a side view cross section of another exemplary container additive system according to aspects of the disclosure.

Referring now to FIG. 2A, an isometric view of an exemplary coupler 200 is shown with its base 205 facing upwards. The base 207 of the coupler 200 may include an adhesive film 205 (as shown) to facilitate affixing the coupler 200 to a planar surface of a container (shown in FIG. 2B). In some embodiments, the base 207 may alternatively include structural and/or material features that enable coupling of the coupler 200 to the container (not shown). Other features may include, for example, clips, rubber or cork seals, thread and knurled edges, indented or crimped portions, and the such. As shown, the base 207 may be connected to a tubular type body 210. The body's 210 inside surfaces may include screw-type features 201 to enable at least a portion of the puncturing structure (as shown in FIGS. 1 and 5) engaged therein by rotational motion.

Figure 2B:
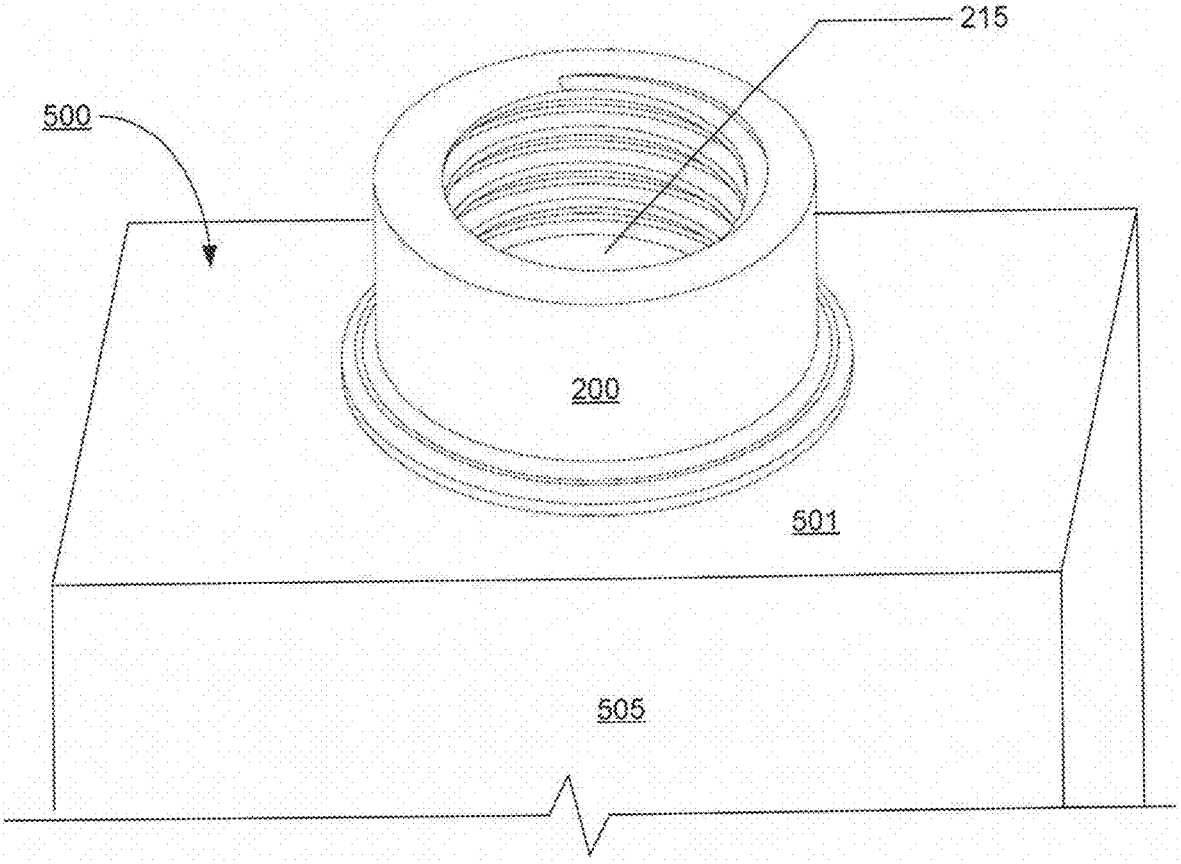
FIG. 2*b* is an isometric view of the exemplary coupler in FIG. 2 positioned on a surface of a container according to aspects of the disclosure.

Referring now to FIG. 2B, an isometric view of an exemplary coupler 200 is shown being fixed to a planar surface 501 of a container 500. More specifically, FIG. 2B illustrates a channel 215 in which the puncturing structure (not shown) can enter into and engage with the coupler 200. In accordance with aspects of the application, the container 500 can seal its contents from the environment for preservation and/or to avoid contamination. The fixing of the coupler 200 to a surface 501 of the container 500 is not compromised until the user desires to dispense its contents, even after a separately packaged additive is added and mixed with the container's contents 505.

Figure 3:
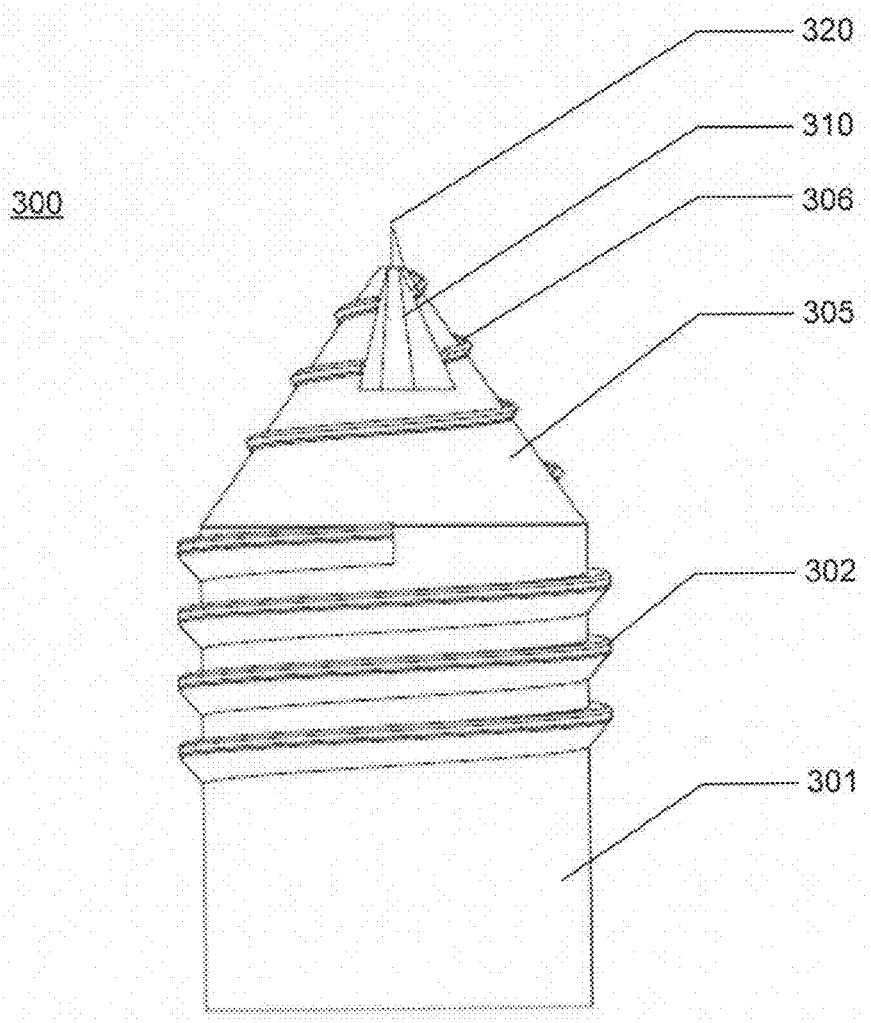
FIG. 3 is a side view of an exemplary puncturing structure according to aspects of the disclosure.

Referring now to FIG. 3, a side view of an exemplary puncturing structure 300 is shown. More specifically, the puncturing structure 300 having a body 302 with a cone shaped end 305. At least a portion of the body 301 may include a complementary twist-type 302 structure for engaging the puncturing structure 300 into the channel 215 of the coupler 200 (shown in FIG. 2B). The cone shaped end 305 can also include a helical structure 305 that may serve to drill into the surface of the container (shown in FIG. 2B) A converging end 320, for example, a sharp blade) may also be included for use of the puncturing structure 300 with more rigid packaging solutions. In some embodiments, a safety mechanism (not shown), such as, a protective spring loaded cylindrical cover may be included as a safety feature. In accordance with aspects of the disclosure, the body 301 and cone shaped end 305 can include a dispensing path 306 that may open in at least a portion of one or both of the body 301 and the cone shaped end 305.

Figure 4:
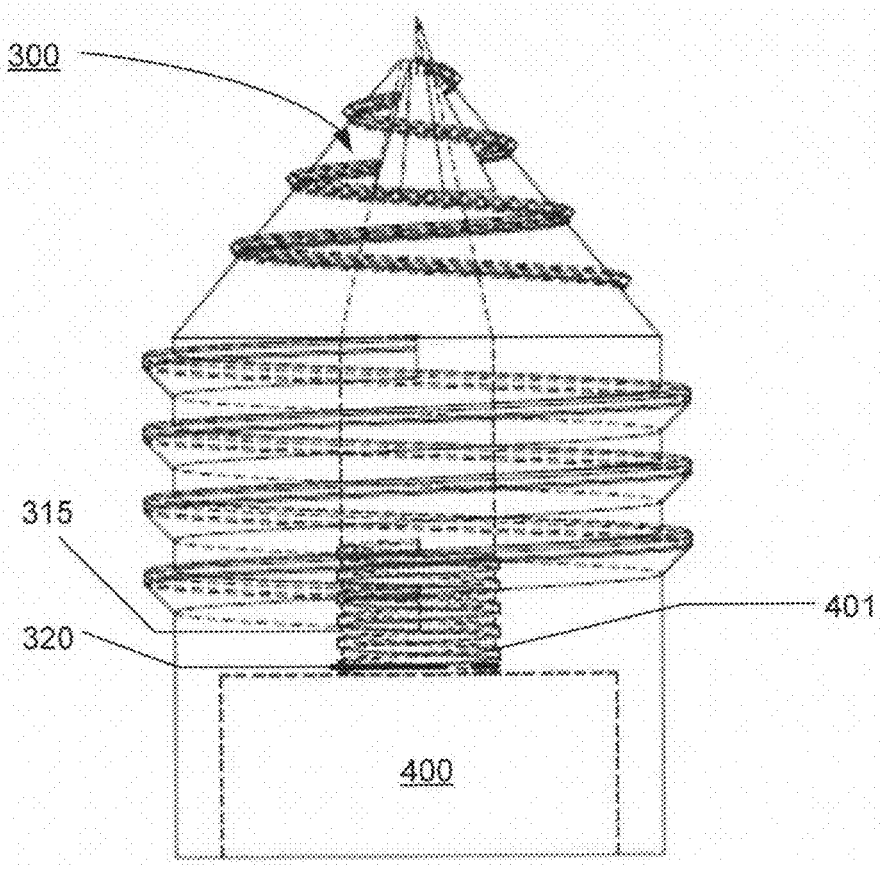
FIG. 4 is a side view cross section of the exemplary puncturing structure of FIG. 3 coupled to a receptacle according to aspects of the disclosure.

Referring now to FIG. 4, a side view cross section of the exemplary puncturing structure of FIG. 3 coupled to a receptacle is shown. More particularly, it is shown how the puncturing structure 300 may include yet another engagement mechanism 315, such as, a screw type structure shown to engage with complementary features 401 of a receptacle 400 used to separately contain an additive. In some embodiments, a valve 320 and/or pre-perforated seals and/or reinforcement strips may be included for controlled mixing of the additive in the receptacle 400 into the contents of the container 500. The receptacle 400 that attached into the puncturing structure may be a tubular, bag, or any other type that may be suitable to contain the contents to be added to the container 500. In alternative embodiments, the puncturing structure 400 itself may include the receptacle and contents incorporated in its body. This may be desired when the puncturing device is meant to be disposable and/or in low volumes.

Referring now to FIG. 5, a side view cross section of another exemplary container mixing system according to aspects of the disclosure is shown. In particular, FIG. 5 shows how rotating A the receptacle 400 engages with the puncturing structure 300, rotating B can engage the puncturing structure 300 to engage with the coupler 200 to then breach a surface of the package 500, all while the contents of the container 500 and the receptacle 400 remain unexposed to the environment. By this function, the container additive system 100 can enable a user to mix the additive in the receptacle 400 in a controlled fashion and right into the container 500 (i.e. without the user having to pour the contents of the container out for mixing). The container 500 for mixing reducing usage of additional bowls, for example, and doing so in a sterile and practical manner. For the retailer, this solution also enables the stocking of more combinable goods without compromising shelf space or shelf life of the different components (since they are separately packaged).

CONCLUSION

In accordance with aspects of the disclosure, as described above and as further defined by the claims below, by enabling a container additive system for controlled mixing and dispensing, and incorporating caps having receptacles of different volumes, configurations, and being complementary to a container or an adaptor for a container, a user may select both pre-determined quantities or type of additive according to his/her own preferences. Inventory can be controlled by a retailer in accordance with consumption or shelf life of the additive and the container product separately. Also, shelf space can be controlled according to consumption but without limiting the options available to the consumer.

It is claimed:

1. A container additive system comprising:

a coupler configured to couple to a puncturing structure having a dispensing path leading to a receptacle for an additive; and the coupler having a base configured to be affixed to a sealed container containing contents that can be complemented by the additive, wherein:

the puncturing structure comprises a cone shaped helical breacher configured to-breach the sealed container after the base is affixed to the sealed container forming a channel between the receptacle and the inside of the sealed container, and the channel leading to the dispensing path of the puncturing structure configured to dispense at least some of the additive onto the contents of the receptable.

2. The container additive system of claim 1, wherein the coupler has a tubular body having a coupling mechanism used to connect the puncturing structure inside the tubular body.

3. The container additive system of claim 2, wherein the base of the coupler includes an adhesive for the affixing of the coupler onto the container.

4. The container additive system of claim 2, wherein the coupler is additionally configured to serve as a cap of the container.

5. The container additive system of claim 1, wherein the puncturing structure comprises a sharp breaching structure configured to breach a portion of a surface of the container.

6. The container additive system of claim 1, wherein the puncturing structure comprises a coupling mechanism to connect the receptable thereon.

7. The container additive system of claim 1, wherein the puncturing structure comprises a receptacle for separate containment of the additive.

8. A container additive system comprising:

a coupler configured to couple to a puncturing structure having a dispensing path leading to a receptacle for an additive; and the coupler having a base configured to be affixed to a sealed container containing contents that can be complemented by the additive, wherein:

the puncturing structure comprises a cone shaped helical breacher configured to breach the sealed container and form a channel between the receptacle and the inside of the sealed container, and the channel leading to the dispensing path of the puncturing structure configured to dispense at least some of the additive onto the contents of the receptable.

9. The container additive system of claim 8, wherein the coupler has a tubular body having a coupling mechanism used to connect the puncturing structure inside the tubular body.

10. The container additive system of claim 9, wherein the coupler is additionally configured to serve as a cap of the container.

11. The container additive system of claim 8, wherein the puncturing structure additionally comprises a sharp breaching structure configured to breach a portion of a surface of the container.

12. The container additive system of claim 8, wherein the puncturing structure additionally comprises a coupling mechanism to connect the receptable thereon.

13. The container additive system of claim 8, wherein the puncturing structure additionally comprises a receptacle for separate containment of the additive.

* * * * *